US010650707B2

(12) United States Patent
Ludlow et al.

(10) Patent No.: US 10,650,707 B2
(45) **Date of Patent: *May 12, 2020**

(54) MERCHANDISE LABELING

(71) Applicant: Bedford Industries, Inc., Worthington, MN (US)

(72) Inventors: Robert B. Ludlow, Worthington, MN (US); John B. Linquist, Sibley, IA (US); Colin M. O'Donnell, Worthington, MN (US); Ryan M. Korpela, Saginaw, MN (US)

(73) Assignee: Bedford Industries, Inc., Worthington, MN (US)

( * ) Notice: Subject to any disclaimer, the term of this patent is extended or adjusted under 35 U.S.C. 154(b) by 17 days.

This patent is subject to a terminal disclaimer.

(21) Appl. No.: 16/001,189

(22) Filed: Jun. 6, 2018

(65) Prior Publication Data

US 2018/0286291 A1 Oct. 4, 2018

Related U.S. Application Data

(63) Continuation of application No. 15/400,194, filed on Jan. 6, 2017, now Pat. No. 10,019,915, which is a continuation of application No. 14/803,473, filed on Jul. 20, 2015, now Pat. No. 9,576,509, which is a continuation of application No. 14/103,204, filed on Dec. 11, 2013, now Pat. No. 9,105,205, which is a continuation of application No. 13/875,099, filed on May 1, 2013, now Pat. No. 8,631,599, which is a continuation of application No. 13/207,120, filed on Aug. 10, 2011, now Pat. No. 8,438,766, which is a continuation of application No. 12/638,433, filed on (Continued)

(51) Int. Cl.

| | |
|---|---|
| ***G09F 3/14*** | (2006.01) |
| ***G09F 3/04*** | (2006.01) |
| ***G09F 3/20*** | (2006.01) |

(52) U.S. Cl.

CPC ..... *G09F 3/14* (2013.01); *G09F 3/04* (2013.01); *G09F 3/206* (2013.01); *Y10T 24/1408* (2015.01)

(58) Field of Classification Search

None

See application file for complete search history.

(56) References Cited

U.S. PATENT DOCUMENTS 92,895 A * 7/1869 Southworth ..... G09F 3/14 40/27
109,263 A * 11/1870 Southworth ..... G09F 3/14 40/27

(Continued)

*Primary Examiner* — David R Dunn
*Assistant Examiner* — Christopher E Veraa
(74) *Attorney, Agent, or Firm* — Mai-Tram D. Lauer; Westman, Champlin & Koehler, P.A.

(57) ABSTRACT

A unitary sheet-like merchandise labeling article that has a labeling tag flatly conjoined along a unifying flat bond zone with a flexible elastic layer that extends away from the tag and includes an elastic fastening loop. The loop sides that define the loop are wider than the thickness of the elastic layer. Further, the flexible elastic layer that extends away from the tag has a thickness greater than the thickness of the tag and has a dispersion zone adjacent the unifying flat bond zone. The dispersion zone allows dissipation of elastic loop in-line stretching forces sufficiently to reduce transmission of such forces into the bond zone.

19 Claims, 2 Drawing Sheets

Related U.S. Application Data

Dec. 15, 2009, now Pat. No. 8,011,127, which is a continuation of application No. 11/861,003, filed on Sep. 25, 2007, now Pat. No. 7,640,687, which is a continuation of application No. 10/895,177, filed on Jul. 20, 2004, now Pat. No. 7,281,345.

(60) Provisional application No. 60/542,153, filed on Feb. 4, 2004.

(56) References Cited

U.S. PATENT DOCUMENTS 134,116 A * 12/1872 West ..... B43L 1/02 248/118.1
224,958 A * 2/1880 Rowland ..... G09F 3/14 40/665
263,600 A * 8/1882 Searing ..... G09F 3/14 40/27
D28,619 S * 5/1898 McFadden ..... D20/22
2,516,292 A * 7/1950 Bennett ..... B65D 63/10 40/665
3,164,250 A * 1/1965 Paxton ..... B65B 51/043 206/343
3,545,795 A * 12/1970 Hertel ..... F16B 11/006 403/265
3,602,957 A * 9/1971 Chang ..... B65D 63/109 24/16 PB
3,621,809 A * 11/1971 Paxton ..... G09F 3/12 40/645
3,662,480 A * 5/1972 Gilson, Jr. ..... G09F 3/14 40/663
3,749,622 A * 7/1973 Sato et al. ..... B29C 65/02 156/157
3,777,378 A * 12/1973 Sant'Anselmo ..... G09F 3/14 40/27
3,930,506 A * 1/1976 Overend ..... A61B 17/1322 606/203
3,933,560 A * 1/1976 Muttera ..... G09F 3/10 156/227
4,119,449 A * 10/1978 Gould ..... B29C 65/0627 156/73.5
D251,121 S * 2/1979 Smith ..... D19/10
4,341,303 A * 7/1982 Britt ..... B26F 1/18 206/343
4,407,082 A * 10/1983 Stehouwer ..... G09F 3/14 156/73.1
4,433,498 A * 2/1984 Bienz ..... G09F 3/0358 24/3.6
4,519,178 A * 5/1985 Crabb, Jr. ..... B65B 13/022 100/9
4,749,426 A * 6/1988 Wyss ..... B29C 37/0082 156/157
5,018,286 A * 5/1991 Zahner ..... G09F 3/0352 24/16 PB
5,087,306 A * 2/1992 Cheung ..... B29C 65/02 100/3
5,131,614 A * 7/1992 Garcia ..... A47B 21/0371 248/118
D338,195 S * 8/1993 Sugerman ..... D14/461
5,322,724 A * 6/1994 Levens ..... B29C 44/352 428/57
5,348,781 A * 9/1994 Koblella ..... B29C 65/0636 428/57
5,617,656 A * 4/1997 Ludlow ..... G09F 3/14 40/665
D385,581 S * 10/1997 Linz ..... D20/42
D386,211 S * 11/1997 Taparauskas ..... D20/22
5,697,177 A * 12/1997 Ludlow ..... G09F 3/14 40/663
5,713,467 A * 2/1998 Kao ..... B65D 73/0014 206/349
5,733,652 A * 3/1998 Stowman ..... B65D 63/1009 156/60
5,778,583 A * 7/1998 Larsen ..... G09F 3/14 40/637
6,024,225 A * 2/2000 Van der Donk ..... B26F 1/3866 100/9
6,058,639 A * 5/2000 Tinklenberg ..... G09F 3/04 40/637
6,076,669 A * 6/2000 Ling ..... B65D 73/0064 206/349
6,116,653 A * 9/2000 Oberholzer ..... B24D 15/00 283/101
6,270,834 B1 * 8/2001 Burrows ..... H05B 33/00 156/182
6,271,631 B1 * 8/2001 Burrows ..... G09F 13/22 313/511
6,355,403 B1 * 3/2002 Bourdelais ..... G03C 1/46 430/394
6,378,700 B1 * 4/2002 Tong ..... B65D 73/0064 206/349
6,413,122 B2 * 7/2002 Fujioka ..... H01R 13/6453 361/796
D494,066 S * 8/2004 Liu ..... D9/415
D501,892 S * 2/2005 Perry ..... D20/10
2003/0008082 A1 * 1/2003 Dronzek, Jr. ..... B32B 27/32 428/34.1
2003/0150919 A1 * 8/2003 Blank ..... G06Q 20/342 235/487
2004/0038026 A1 * 2/2004 Li ..... B32B 15/08 428/354

* cited by examiner

MERCHANDISE LABELING

CROSS-REFERENCE TO RELATED APPLICATION(S)

This application is a continuation of U.S. patent application Ser. No. 15/400,194, filed Jan. 6, 2017, which is a continuation of U.S. patent application Ser. No. 14/803,473, filed Jul. 20, 2015, now U.S. Pat. No. 9,576,509; which is a continuation of U.S. patent application Ser. No. 14/103,204, filed on Dec. 11, 2013, now U.S. Pat. No. 9,105,205; which is a continuation of U.S. patent application Ser. No. 13/875,099, filed on May 1, 2013, now U.S. Pat. No. 8,631,599; which is a continuation of U.S. patent application Ser. No. 13/207,120, filed on Aug. 10, 2011, now U.S. Pat. No. 8,438,766; which are incorporated by reference in their entirety.

U.S. patent application Ser. No. 13/207,120 is a continuation of U.S. patent application Ser. No. 12/638,433, filed Dec. 15, 2009, and issued as U.S. Pat. No. 8,011,127.

U.S. patent application Ser. No. 12/638,433 is a continuation of U.S. patent application Ser. No. 11/861,003, filed Sep. 25, 2007, and issued as U.S. Pat. No. 7,640,687.

U.S. patent application Ser. No. 11/861,003 is a continuation of U.S. patent application Ser. No. 10/895,177, filed Jul. 20, 2004, and issued as U.S. Pat. No. 7,281,345.

U.S. patent application Ser. No. 10/895,177 claims the benefit of U.S. Provisional Patent Application No. 60/542,153, filed Feb. 4, 2004.

FIELD

This invention relates to an article for merchandise labeling and more particularly to an article that has a labeling tag flatly conjoined along a unifying flat bond zone with a flexible elastic layer that includes an elastic fastening loop.

BACKGROUND

The prior art is replete with merchandise labeling using bands about merchandise. Sometimes the heretofore known bands have elastic sections united to non-elastic sections, and sometimes they are endless elastic bands commonly called rubber bands.

For example, U.S. Pat. No. 2,516,292 (Bennett) of Jul. 25, 1950 teaches a preformed labeling band of elastic and non-elastic sections for holding bananas constantly under tension as they shrink. The ends of the elastic and non-elastic sections of the band are overlapped and adhesively or otherwise bonded together. U.S. Pat. No. 5,733,652 (Stowman et al.) of Mar. 31, 1998 discusses banding of merchandise by a technique involving in situ bonding of the ends of a strip of elastic material with or without an interposed separate strip of material that is not necessarily elastic. In situ bonding, however, involves carrying bonding equipment to the site where banding of merchandise is to be done (e.g., for bonds formed by heat sealing) or involves removing and disposing of a release liner at the site of banding (e.g., for bonds formed by using liner-protected contact or pressure-sensitive adhesive layers). Neither approach is ideal for field application of labels. Also, when either a preformed band of bonded sections or an in situ formed band of bonded sections is stretched about merchandise, it exerts a compressive force on the merchandise. Relatively strong bonds are needed to prevent bond separation under such circumstances since the bonds are in the line of stretching and are subjected to the tension of stretching during use. A still further problem is the questionable reliability for UPC bar codes on stretched bands encircling merchandise.

Where endless bands of rubber (commonly called rubber bands) are used as in teachings of U.S. Pat. No. 5,617,656 (Ludlow et al.); U.S. Pat. No. 5,697,177 (Ludlow et al.); and U.S. Pat. No. 6,058,639 (Tinklenberg), a second step arises for attaching the tag. The two-step approach is not the most desirable although it has been one of the more popular approaches in the past because the tag is distinct from the rubber band and can carry reliable UPC bar coding that is easy to handle at checkout scanning.

Heretofore, the only known merchandise marking article capable of single-step application to achieve simultaneous banding and absolutely scan-reliable bar-coding of merchandise is described in U.S. Pat. No. 5,778,583 (Larsen) of Jul. 14, 1998, where the tag is attached to the rubber band by encircling a section of the tag about the rubber band prior to the time the rubber band is fastened in banding condition about merchandise. Economy is not a hallmark for the manufacture of this prior art article.

In short, a one-step process using an economical unitary product for reliable and simultaneous tagging and banding of merchandise, including for tagging and banding clumps of agricultural produce, is much desired by industry and has been much sought after for a very long time.

SUMMARY

The new merchandise labeling article of this invention relies upon entirely new physical features and relationships. Significantly, the new article is sheet-like throughout. It has a labeling tag and an elastic fastening loop conjoined along a unifying flat bonding zone. The loop extends away from the tag.

Despite the fact that the loop lacks the physical appearance of the usual rubber band, it can function much the same as a rubber band in holding a clump of merchandise together and thus effectively band merchandise. Ideal tagging products of this invention can have an easily scanned UPC bar code on the tag portion.

A very interesting feature of the preferred new article becomes apparent when the fastening loop is stretched around merchandise. The stretch and contraction forces exerted in the loop are, for the most part, not strongly transmitted into the bonding zone between the tag and the loop. This permits the bond at the bonding zone to be relatively reduced in strength as compared to the bond in the line of stretch of a band.

Many other novel advantages, features, and relationships will become apparent as this description proceeds.

DETAILED DESCRIPTION

Figure 1:
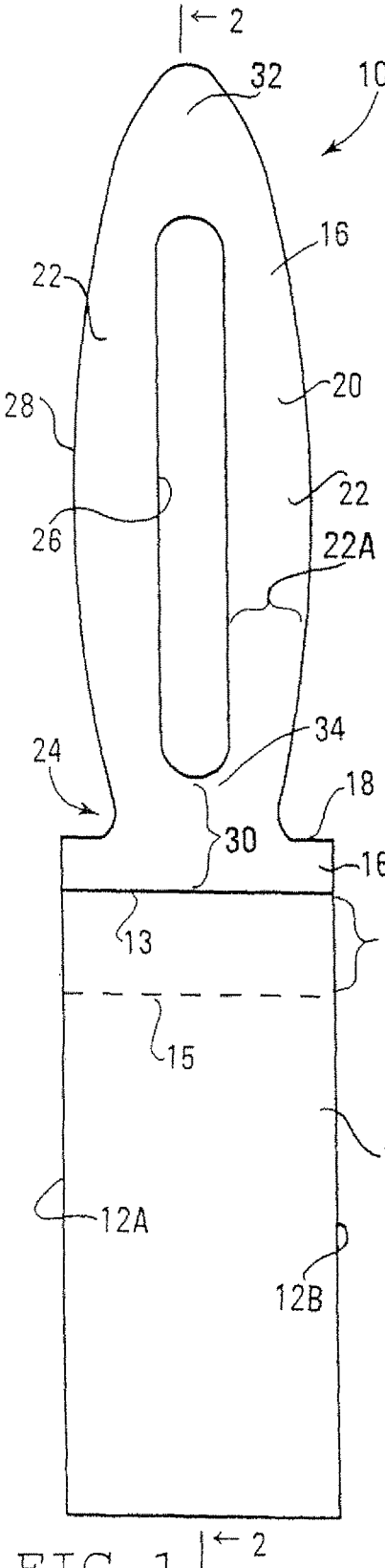
FIG. 1 is a schematic frontal (face) view of an illustrative merchandise labeling article of this invention.
Figure 2:
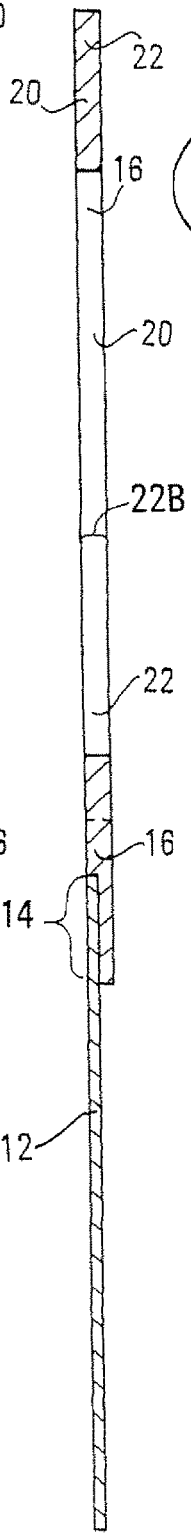
FIG. 2 is a schematic cross-sectional view taken on line 2-2 of FIG. 1.
Figure 5:
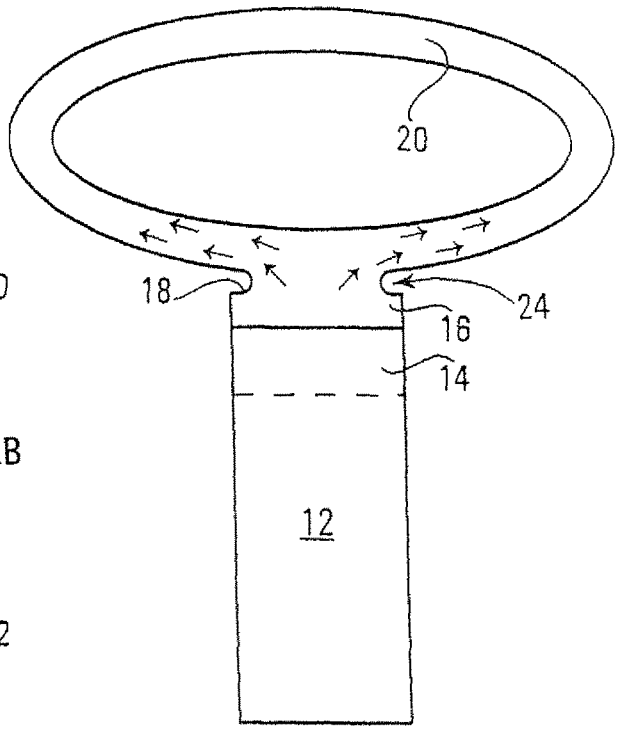
FIG. 5 is a schematic frontal view of a merchandise labeling article of the invention with the elastic loop stretched laterally and with arrows illustrating the direction of stretch in the neck area of the new article and particularly illustrating how the stretching in the neck area reduces the transmission of in-line stretching forces into the bond zone that conjoins the elastic layer with the tag itself.
Figure 3:
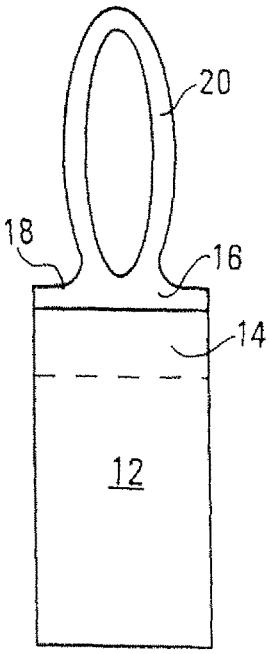
FIGS. 3 and 4 are schematic frontal views of other illustrative merchandise labeling articles of the invention.
Figure 4:
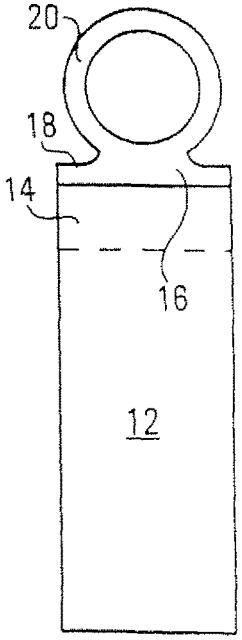
Figure 6:
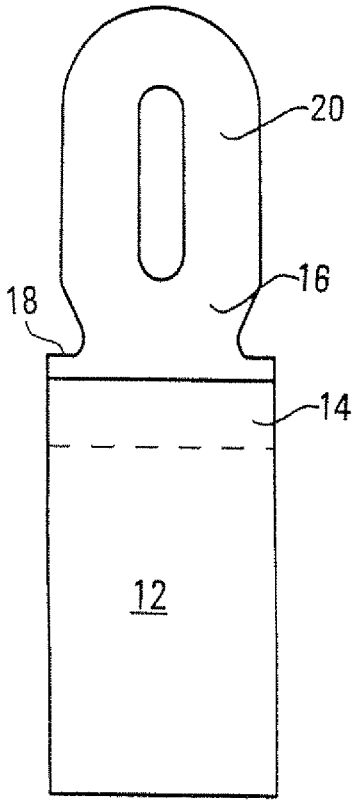
FIGS. 6, 7, and 8 are schematic frontal views of illustrative new articles having varied elastic fastening loops.
Figure 7:
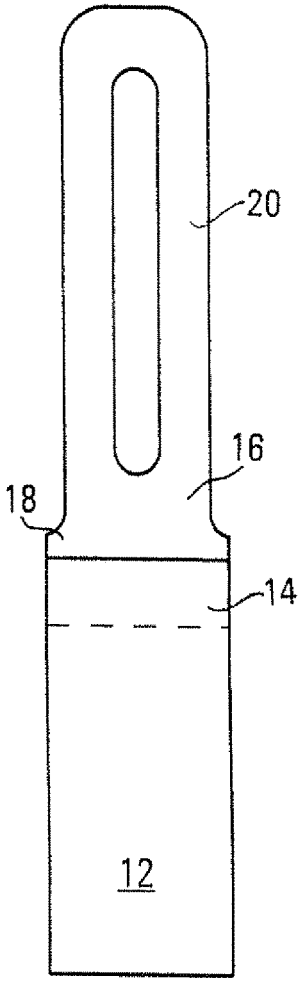

It first should be noted that FIGS. 1 and 2 may be looked upon as somewhat enlarged views of a new article of the invention. Their size permits easier illustration of the different parts of the new article. Of course, new articles as large or larger than the size of FIGS. 1 and 2 are within the scope of this invention. However, FIGS. 3, 4, and 5 are more representative of the actual size for many new articles of the invention that are expected to be the most popular—it being recognized that economy of material usage contributes to economy of resulting price for purchasers. In rare instances, however, the question of price can take second place to the importance of large and dominating articles of the invention.

Referring to FIGS. 1 and 2, the new article has a labeling tag 12 flatly conjoined along a unifying flat bond zone 14 with a flexible elastic layer 16 that extends away from the tag 12 and contains an elastic fastening loop 20 that has flat loop sides 22 that define the fastening loop and are wider (as illustrated at 22A in the view of FIG. 1) than they are thick (as illustrated at 22B in the view of FIG. 2). The entire article is sheet-like in the sense that tags are sheets of a flat nature and layers (as of elastic) are also sheets of flat character although they may be drapeable and floppy and thus not always displayed in flat form. The key point is that the sheet of tag material and sheet of elastic layer material are flatly conjoined, which means that the tag and elastic layer are not joined in a perpendicular relationship to each other. Instead, they are joined so that the sheet character of each extends into the sheet character of the other, giving a total unitary sheet-like character to the entire product. Further, the result is a unifying flat bond zone at the conjoining of the tag and elastic layer. Details for that bond zone are discussed below.

The width of the tag 12 between its sides 12A and 12B in the bond zone 14 and the width of the elastic layer 16 in the bond zone are preferably about equal.

The flexible elastic fastening loop 20 has an internal edge circumference 26 that defines the boundary of the hole through the loop as well as the inside edge circumference of the loop. The outer edge or boundary of the loop can be looked upon as its outer circumference 28. Both boundaries for the sides of the loop lie in the flat plane of the elastic layer 16, and thus the sides 22 of the loop (being part of the elastic layer) are also properly looked upon as flat. To summarize, the elastic fastening loop has flat loop sides 22; and those sides define the loop and its inner or internal edge circumference 26 and its outer or external edge circumference 28. The outer circumference includes a section that merges into the bond zone 14.

The distal end 32 of the loop is the end furthest from the bond zone 14, and the proximal end 34 of the loop is closest to the bond zone. The proximal end of the inner circumference 26 may itself optionally (but not preferably) merge into the bond zone. Ideally, the proximal end 34 of the inner circumference 26 is spaced from the nearest edge 13 of the bond zone 14. The farthest edge 15 of the bond zone 14 is most remote from the loop. The edges 13 and 15 of the bond zone 14 should be looked upon as schematically illustrated in the drawing simply because the unification between an overlapped edge of the tag 12 and an overlapped edge of the elastic layer 16 can take a variety of forms, including those that may make the nearest edge 13 of the bond zone as well as the farthest edge 15 of the bond zone somewhat irregular or even greatly irregular.

Nevertheless, the distance between the proximal portion of the inner circumference 26 and the nearest edge 13 of the bond zone is most preferably sufficient to provide a zone 30 which can be called a dispersion zone. Its function is to disperse at least some of the in-line tension forces created as a result of the stretching of an elastic loop about merchandise. Those tension forces are called "in-line" tension forces because they are in the line of stretching of the loop. Dissipation of such tension forces is desirable at least to some extent so as to reduce (or sometimes even substantially eliminate) the stress of that tension passing into the bond zone 14.

The interesting thing about the new labeling article of the invention is the fact that substantial dispersion or even dissipation of those in-line tension (i.e., stretching) forces can take place in the dispersion zone so as to quite significantly temper or reduce the stress those forces put on the bond zone 14. FIG. 5 illustrates the tension forces that arise within the elastic loop on stretching it about merchandise. Significantly, the lateral shoulders 18 created by forming a neck indentation 24 at the proximal end of the elastic layer containing the elastic loop 20 tend to assist in relieving or dissipating tensioning forces within a stretched loop from being transmitted into the bond zone 14 at its lateral edges. Thus, a relatively weaker unification between the tag and the elastic layer at the bond zone is permissible for the new article of the invention as compared to the strength of unification in a bond zone needed between a strip of elastic material and any other material that forms a band about merchandise where the bond zone between parts of the band is continually subjected to the tension of a band stretched about merchandise.

Ideally, the dispersion zone 30 should be at least as deep (i.e., "wide" in the direction away from the bond zone) as about half the narrowest width (see 22A) of the loop sides, and preferably should be somewhat larger, such as at least about equal to the narrowest width of the loop sides. Effective dispersion function generally requires some minimal distance between the proximal end of the inner circumference 26 and the nearest edge of the unifying bond zone 14. The minimum distance should be at least about 50 mils (preferably more) even for the narrowest of practical widths for elastic loops in the practice of the invention. More appropriately, the minimal distance between the proximal end of the inner circumference 26 and the bond zone 14 should be about ⅛ inch or 125 mils—and preferably that distance will be greater than ⅛ inch or 125 mils—for what is perceived to become the most popular of the new labeling articles of the invention. The greater the distance of the dispersion zone 30, the more likely lateral tensioning forces in a stretched loop (as illustrated in FIG. 5) will be tempered or even completely dissipated (or substantially so), and not significantly transmitted into the bond zone 14; but practical economy requires the lowest volume of usage of material effective to accomplish the function desired. Thus, dispersion zones 30 in excess of about ½ inch or 500 mils in depth (as well as loop sides wider than about ½ inch or 500 mils) will be relatively rare and likely realistic only for labeling articles of the invention where expense is of no great concern. Nevertheless, dispersion zones of a depth of ¾ inch (750 mils) or even a full inch can sometimes be useful to reduce the passage of the tension of stretching into the bond zone. Similarly, loop sides of similar greater width (e.g., ¾ inch and even a full inch) can sometimes be useful (e.g., where larger articles of the invention are needed). Generally, and especially for banding agricultural produce, economy for the new product is a critical consideration and will dictate dispersion zones and loop sides no greater than necessary to maintain integrity for the product in the use expected of it.

It is appropriate to emphasize that the proximal end of the inner circumference 26 of the loop 20 is preferably distanced from the bond zone 14 by the dispersion zone; and when shoulder 18 is present, the proximal end of the inner circumference 26 should be more distant from the bond zone 14 than the optional shoulder 18 that contributes to forming the lateral indentations that in turn form the neck 24 of constricted width for the elastic layer 16.

Figure 8:
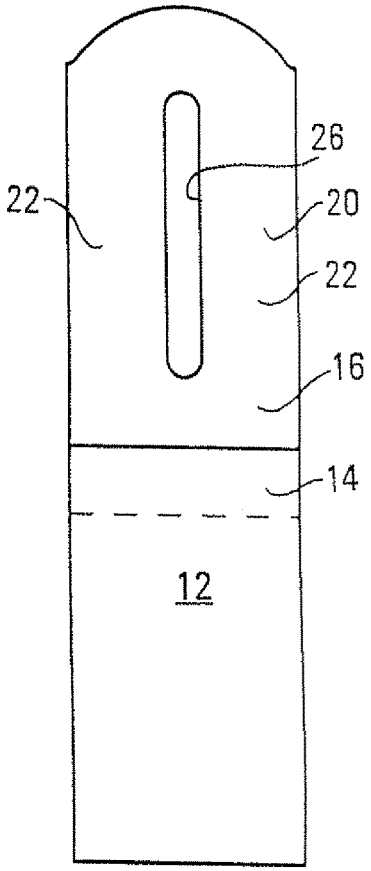

Features in FIGS. 3, 4, 5, 6, 7, and 8 are numbered using the same numbering as in FIGS. 1 and 2. Thus, in these figures, the ideal flat labeling tag 12 is flatly conjoined along a unifying flat bond zone 14 with an elastic layer 16 containing an elastic fastening loop 20 that extends away from the tag and has flat loop sides that define the fastening loop and are wider than they are thick—all as discussed in connection with FIGS. 1 and 2. The significant thing about FIG. 3 is that its profile as shown has substantially the same dimensions (other than the longitudinal length of the tag) for its different parts as in several practical convenience articles of the invention used for marking agricultural produce as well as other products. The ideal FIG. 3 style of product has a tag about 1 inch wide and anywhere from about 1 inch to about 5 inches long, plus an elastic layer not wider than about 1 inch (i.e., not wider than the width of the tag) and anywhere from about 1 inch to about 4 or 5 inches (preferably about 1¾ or 2 or 3 inches) in length from the bond zone 14. It has a transverse bond zone formed at the overlap of the conjoined edges of the tag and elastic layer. That overlap is generally about 3/16 or ¼ inch or even ⅜ inch but usually not over about ½ inch or more. FIG. 4 also is an illustration where the dimensions of the showing are essentially identical to practical products of the invention, but to be especially noted is that the elastic loop of FIG. 4 is circular as distinct from oval, which sometimes may be a preference of shape for specialized labeling applications (especially for bottles). To be noted is that FIGS. 3, 4, 5, 6, and 7 illustrate a shoulder 18. FIG. 8 does not. The width of the loop sides 22 in FIG. 8 is greater than in any other frontal view illustrated and is accompanied by a very narrow central opening defined by the internal circumference 26 for that opening.

Referring to FIG. 5, the oval elastic loop there illustrated is in a laterally stretched orientation that puts its stretched longest dimension in a lateral or transverse direction (e.g., parallel with bond zone 14). If that loop were looked upon as non-stretched, the loop's longest dimension would be greater than the width of the tag. Elastic layers that have their longest non-stretched dimension extending transverse to the depending tag are within the ambit of the invention; but are not preferred. The most preferred articles of the invention will usually have their elastic loop so oriented that the outer circumference 28 will never reach a lateral or transverse extent beyond the widest lateral extent for the sides of the labeling tag 12. This preference applies to the widest lateral width between the sides 12A and 12B of the tag 12. Rectangular style tags are by far the more practical for economy purposes, but tags themselves may indeed take different forms such as octagonal shapes, triangular shapes, rhomboidal shapes, circular shapes, oval shapes, and even irregular shapes. The maximum distance between the sides 12A and 12B is ideally always greater than the maximum lateral (transverse) distance for the outer boundary or circumference 28 of the elastic loop. Further, when labeling tags other than generally rectangular ones or square ones are used, the bond zone 14 may vary in lateral extent, and features such as the shoulders 18 and the neck indentation 24 may be modified or even omitted; but a dispersion zone 30 preferably will always be maintained so as to temper the transmission of tension forces into the bond zone 14 when the elastic loop is stretched about merchandise.

The thickness of tags for practicing the invention should be great enough to give some body effect but ideally will not be greater than necessary for carrying appropriate information to describe a product or whatever item the tag is designed to identify. The tag should be in the form of a continuous panel of sheet material, although tags with holes in them are within the ambit of the invention. Suitable sheet material for tags is preferably relatively thin, generally not over about 15 or 20 mils (i.e., 0.015 or 0.020 inch) in thickness (although thicknesses up to 30 or 40 mils can be used where cost is no object). The tag material should be flexible and pliable but is most preferably not elastic for most applications. Of course, UPC codes on elastic materials can sometimes perform satisfactorily for scanning purposes, but uncertainty as to reliability for that performance has to be considered. (A stretchy but non-elastic material such as the polyolefin thermoplastic printable microporous product called "Teslin" from PPG Industries of Pittsburgh, Pa. can sometimes be used as tag material for the new article of the invention where pulling distortion of the tag is expected to be only nominal, or zero. Use of "Teslin" is not preferred because it can be stretched by hand pulling and is extremely slow in any tendency to return to its original, shape. It lacks the bounce-back feature of elastic material.) For the most part, the tag material preferably should, be sufficiently non-stretchy under hand-applied forces that a UPC scannable code is not rendered unreliable for scanning. Thus, the sheet material should have the dimensional stability to carry a reliably scannable (i.e., non-distorted) print of a UPC code as well as other easily read markings.

The sheet material for the tag also preferably should be sufficiently water resistant to not disintegrate and not significantly pucker or wrinkle or otherwise disfigure or deform when placed in water. In fact, not only the sheet material but also the printing on it, and especially any scannable product identification matter on it, should ideally be sufficiently water resistant to avoid disintegration or destruction when repeatedly subjected to water and washing operations (as is common for produce displays in supermarkets). The sheet material for the tag also should be somewhat tough in the sense of being sufficiently tear resistant to deter damage to it from customer handling.

Useful materials for forming the tag sheet material include paper (which is not preferred), polystyrenic thermoplastics (which are among those preferred especially when composed or treated for good printing ink reception) as well as polyolefinic thermoplastics, polyesters, and others that exhibit the properties discussed (which can vary depending on how the new article of the invention is to be used in the marketplace). Thermoplastic materials are best to use, and polymers of styrene, ethylene, propylene, as well as a variety of other monomers and mixtures of monomers (e.g., to make co-polymers and ter-polymers, etc.) can be used. Sheet thickness for polyester plastics and some others can be quite thin, even down to the 3 or 4 mil range, and still exhibit the toughness and the practical non-elasticity desired. The polymers may be formulated so that printing inks are readily accepted on the surface of the sheet material or treated with special surface treatments to effect acceptance of printing inks. The exact structure and composition of suitable tag sheet material for practicing the invention can vary widely.

Any of a variety of commercially available inks compatible or accepted on a tag sheet and retained thereon, and in any desired color, may be used to print the markings and details of the information portion of the tag. Such technology is readily understood in the art. (If it should be desired to use water-soluble ink markings, a thin film of water-insoluble plastic may be applied over them to enhance water resistance.) High-impact polystyrene sheets are especially useful as tag material. To improve impact properties toward the high end, a styrene-butadiene-styrene impact modifier can be useful in amounts up to about 40 percent of the weight of the polystyrene itself. Tags of such material are highly stable against stretching of the type that will damage scannability for bar codes. They have desired flexibility balanced by a slight stiffness that contributes to ease of handing during manufacture of the new product and also to ease of handling during use of the new product, including scanning of a UPC code at check-out counters. Such tags also can be reliably printed, especially when first subjected to a surface treatment such as, for example, a corona treatment such as available from Pillar Technologies of Hartland, Wis., a division of Illinois Tool Works. The treatment is said to enhance wettability and adhesion characteristics of plastic substrates to inks and adhesives. It cannot be overemphasized that, where reliably scannable UPC markings are critical, the tag portion of the new sheet-like product should be substantially non-elastic, that is, sufficiently non-elastic to avoid the risk of unscannable distortion for the code.

The size of the front and rear surfaces of the tag 12 for the new article can vary depending on the purpose for which the new article is being formed. For the most part, tags 12 having front and rear areas (rectangular, square, oval, etc.) of at least about 1 square inch are preferred, although even smaller tag areas may be used when minimal printing on the tag is to be employed. Generally, the size of tags is no greater than that necessary to carry the informational matter to be printed on the tag, such as a scannable UPC code, PLU numbers, any product description, illustration, or the like, as well as any special trademarks or source markings, addresses, and phone numbers, etc. The more popular tags are apt to a have a size of at least about 1½ or 2 square inches up to about 3 or 4 square inches, although larger sizes can, of course, be used. Sizes above about 6 or 7 square inches, however, are likely to be rare. Nevertheless, tags as large as 10 square inches or even 15 or 20 square inches are contemplated as within the scope of the invention.

The elastic portion of the new product will generally have a layer thickness that is greater than the thickness of the tag portion by at least about 20 percent up to about four or even five or six times the thickness of the tag portion (as for example where tags having a thickness of only about 6 or 8 mils are employed). Preferably the thickness of the elastic layer that extends away from the tag will have a thickness greater than about twice the thickness of the tag, but usually will not exceed about 30 or 35 mils when the tag thickness lies in what is expected to be the popular range of about 5 to about 10 mils. It is conceivable, of course, to form the new product with a tag thickness and elastic layer thickness approximately equal (especially where one employs fusion bonding for the bond zone between the tagging material and the elastic material). It is also conceivable to use elastic layer thicknesses up to but not usually greater than 100 mils. (In articles where the bond zone reveals the thickness of the tag as well as the elastic layer, the elastic layer generally should be at least as thick as the tag or even at least twice the thickness of the tag in that bond zone.) Because strong need exists to make useful product in the most economical manner, the amount of material (for thickness and size) used in making the product should be kept to a minimum for satisfactory functional results. Thus, tag thicknesses generally will fall below 10 mils; and the elastic layer, while usually thicker, will generally fall in the range of 15 to 30 mils in thickness.

In all instances, the loop is part of the elastic layer (even though composition may vary) and generally will be of the same thickness as the part of the elastic layer extending out from the bond zone part of the tag. The width (e.g., see 22A) of the sides defining the fastening loop of elastic material will be greater than, and generally at least two or three or five times (and even 10 or 20 times) greater than, the thickness of those sides.

The sides of the loop should have sufficient elastic strength to permit stretching of the loop to an inner circumferential size at least three times greater than the relaxed unstretched inner circumferential size of the loop, and this stretching should be accomplished without fracture for practical products of the invention. The relaxed unstretched inner circumference 26 will vary depending on the size of the opening desired for the loop. The relaxed unstretched inner circumference may range from as little as about 1.5 inches (rarely smaller) up to possibly 5 inches (rarely larger). But the relaxed unstretched inner circumference within the scope of the invention is not limited to the more popular range. Thus, the lower limit of size for the relaxed unstretched inner circumference may be as low as about 0.5 inch or less for some useful products (as for flower work), and the upper limit of size for the relaxed unstretched inner circumference for other useful products may be as great as 10 or 20 or more inches. Generally, the relaxed unstretched inner circumference 26 will not exceed about 6 or 8 or possibly 10 inches for most products, except, of course, for the marking of large-diameter products such as melons. (One must keep in mind that the term "circumferential" is equally apt to describe an edge of an oval or elliptical or a varied similar shape as well as a purely circular or approximately circular shape.)

Ideally, the width 22A of the flat loop sides that define the fastening loop will, at all portions of those sides, be at least 1/10th of an inch or 100 mils (although narrower widths can have specialized uses). The most ideal widths are those that are adequate to insure some degree of strength for the loop as it is placed about merchandise (especially clumped merchandise such as onions or asparagus, etc.) for the purpose of holding the merchandise together. The best widths for flat loop sides thus preferably fall within the range of at least 100 mils (generally at least about ⅛ inch or 125 mils) up to about ½ inch or about 500 mils for elastic layer thicknesses, especially those between about 0.012 inch or 12 mils and 0.030 inch or 30 mils—with the width relatively greater for the thinner thicknesses and relatively less for the greater thicknesses being possible—all to insure adequate loop strength for stretching and retraction about merchandise without causing overuse of material to make the product.

Materials for forming the elastic layer including the elastic loop of it are rubber-like in character. In short, they should bounce back from a stretched condition relatively quickly, but absolutely instantaneous retraction or bounce back to an original relaxed condition after stretching is not always critical for functional elastic performance. Substantially instantaneous retraction to a loop inner circumferential condition no greater than 5 percent above the original unstretched loop inner circumference condition can suffice for a multitude of uses. A substantially instantaneous loop retraction is accomplished when, after relaxation from having been momentarily stretched to a predetermined extent, it takes no more than 3 seconds for the loop to retract (bounce back) to an inner circumference size no more than 5 percent greater than the inner circumference of the original unstretched loop. A momentarily stretched condition is one where the stretch is not held for more than 2 or 3 seconds and the predetermined extent of the stretch is three times (or more) the inner circumference of the loop in unstretched relaxed condition. There may be occasions where retraction may take more than 2 or 3 seconds (up to possibly 5 or 10 seconds) and still may constitute sufficiently speedy retraction to be useful as elastic material in practicing the invention. Those skilled in the art of elastic performance features are well aware that they should select elastomers for the elastic stretch and retraction characteristics required for a particular job they want performed.

In selecting elastomers for the elastic layer, substantially instantaneous retraction is most preferred for rapid clumping of products (because slower retraction may well cause some product to fall out of the clump before retraction takes place). On the other hand, a modestly slower retraction may be quite adequate where new labeling article of the invention is to be stretched about a single product under conditions where speed of retraction (bounce back) is reliable but not the dominant consideration. Of course, the most ideal products of the invention will exhibit almost instantaneous retraction from momentary stretching.

A variety of elastomers giving satisfactory elasticity and stretchability can be useful in practicing the invention. The ideal elastomers are those that are thermoplastic in that they are at least heat softenable and even heat meltable to a flowable or moldable state. A multitude of thermoplastic elastomers are known and more are being created every day. One of the more common families of thermoplastic elastomers is the styrenic block co-polymers. This family includes styrene-butadiene styrene and styrene-ethylene-butylene styrene. Another family of useful thermoplastic elastomers is the olefinic elastomers including those that are ethylene as well as those that are polypropylene based (e.g., where interposed different monomer blocks are not used but blocks of different tacticity—atactic and isotactic—are created by using metallocene catalysis polymerization). Yet another family of thermoplastic elastomers are known as polyvinyl chloride-based elastomers. Still other families of thermoplastic elastomers can be based on urethanes, nylon, silicon, etc. Selection of elastomer is generally made on the basis of cost, and with due attention to bonding characteristics for the tag material selected. Tag material selection is best advised to be from polymers in the same family as the elastomer such as those made up using at least some monomers related to or the same as those present in the elastomer chosen for the elastic layer. Elastomers that cost more are selected only when their special properties are considered functionally important for a particular article of the invention designed for specialized use.

More on elastomers is contained in three pages entitled "Elastomers" and four pages entitled "Thermoplastic Elastomers," all printed Jan. 28, 2004 from the web site of the Department of Polymer Science, University of Southern Mississippi—all incorporated herein by reference. A print of these pages was filed with our provisional application, and a print is separately filed with the filing of this application.

A common practice in handling polymeric materials, whether elastomeric or otherwise, is to add compatible (i.e., readily blendable) ingredients to achieve coloration, opacification, resistance to degradation on exposure to some environments, improved impact properties and adhesion properties, etc., all as well known to those skilled in the polymer chemistry arts.

Usually, the elastomeric layer will be substantially uniform in composition throughout its extent (although an elastomer—or mixture of elastomers—forming the loop portion may be different from an elastomer at the bond zone provided the two elastomers blend into a reliable unity at their interface). On the other hand, the tag portion of the new article of the invention may in fact be a laminate of different layers, including a possible protective coating over a printed layer, especially a printed layer that is believed to need further protection against smudging or destruction. Generally, the bond zone is formed by overlapping edges of the tag and the elastomeric layer. The overlap can be rather extensive if desired (even up to or approaching an inch) but generally need not be greater than about ½ inch or possibly ⅜ inch. Most (but not all) articles are expected to have tags no greater than about 4 or 5 or 6 square inches in size and elastomeric layers that extend out as the elastomeric fastening loop a distance from the bond zone about 1 inch up to about 4 inches or possibly 5 inches, and the overlap for the bond zone for such tags generally need not exceed ½ inch, or even not exceed ¼ inch. Overlaps as narrow as ⅛ inch may sometimes be successfully used, but such narrow overlaps at the bond zone may create trouble. Sometimes people may pull on the tag 12 as they work to place the loop 20 about merchandise, and once the new article is on merchandise, those concerned about checkout scanning may well modestly pull on the tab for that scanning operation. Sometimes customers will mildly pull on the tab in an effort to learn more about the nature of the new article or the merchandise carrying it. These possibilities suggest against using overlaps that are significantly less than about ¼ inch.

The type of unification between the tag material and the elastic layer can affect the size of the overlap needed for the bond zone and will normally be selected by taking into consideration the particular material or materials of the tag and the particular composition of the elastomeric layer to be conjoined at the bond zone. Heat welding as by applying heat and pressure on overlapping thermoplastic polymeric materials forming the tag and the elastic layer can be useful. Significant heat at the interface of overlapping thermoplastic polymeric materials can also result in complete fusion between the polymer of the tag and the polymer of the elastic layer. Sonic welding is another way to unify the layers and achieve a cohesive bond between compatible parts. Laminating a molten elastomer to a molten (or at least softened) tag composition by co-extrusion is another way of forming the bond zone. This method can be particularly effective where molecules or parts of molecules of the tag polymer and the molten elastomer at the bond zone interdiffuse with each other and get tangled up before being frozen (i.e., before being cooled to a non-flowable state). Bonds can also be formed by interposing an intermediate layer at the bond zone (e.g., a hot melt bonding adhesive) to which both the tag material and the elastomeric layer material will readily bond because of their compatibility to the intermediate material. Still further, special treatment of the surface areas where bonding is to be accomplished can be effective. Even mechanical bonding can be effective, as where the tag material is porous (e.g., paper and the porous polymer product called "Teslin"), and the elastomeric layer is applied in molten condition or at least in a softened condition and pressed into the voids or interstices of the porous tag layer.

In short, the invention contemplates any useful bonding technique and structure that will conjoin the labeling tag with the elastomeric layer in a manner forming a unifying flat bond zone that can withstand (without separation) the pulling force (as expected in use) between a tag and elastic layer. The pulling force normally expected in use may be as little as 1 pound, and the bond should be able to withstand at least such a pulling force for 10 seconds. Bonds capable of withstanding pulling forces of at least 2 pounds for 10 seconds, or even at least 3 or 4 or 5 pounds of pulling force for 10 seconds without rupture (breaking apart) of the bond zone, are preferred. In use, it is not the pulling force per unit area or per cross-sectional area that counts. It is the overall resistance of the entire bond zone to separation. Thus, these low pulling forces are per article of the invention, not per linear unit or any area unit. Such is a relatively low requirement for bond strength. Most likely, the greatest pulling force (tag gripped at one end and elastic loop at the other for pulling in opposite directions) is apt to be momentarily encountered (for no more than 10 seconds and usually much less) and probably only encountered during affixing of the tag about merchandise.

A useful bonding consideration is polymer bonding at the bond zone. It essentially amounts to an adjustment of the materials (e.g., tag and elastomer materials) and adjusting the exact interface characteristics of the materials. Generally, similar materials tend to bond together (as by polymer bonding) better than dissimilar materials; and materials of like polarity usually bond better than materials of unlike polarity. Surface treatments such as corona treatments also help to improve bonding. Still further, compatibilizers that adjust the polarity of material can be used to improve bonding.

A notable product of the invention has a high-impact polystyrene tag and an elastic portion formed using a styrene-butadiene-styrene (SBS) block co-polymer available from GLS Corporation under the tradename "Kraton D-2104." This co-polymer has several beneficial features such as high clarity, good dimensional stability, food contact acceptability, relatively high strength, low viscosity, ease of coloring, and high elongation. To improve its adhesion to a styrenic tag substrate, an optional addition of up to 10 percent by weight of polystyrene (based on the weight of the elastomer in the composition) may be blended in the elastomer composition. The composition can easily be colored, as for example by using polystyrene base color concentrates from Clariant (located at 9101 International Parkway, Minneapolis, Minn. 55428) or by using polyethylene base color concentrates from Ampacet (located at 660 White Plains Road, Tarrytown, N.Y. 10591) at concentrations of up to about 5 percent (or even more but more is unnecessary) of the weight of the base styrene-butadiene-styrene block copolymer.

Those skilled in the art will recognize that any suitable process for the manufacture of the new labeling articles of the invention can be employed. Batch processing is useful for extremely limited production runs. Conveyor processing with indexing from station to station for specific operations in putting each discrete product together can be useful (especially for uniquely designed or shaped tags or elastic layers).

Web-based processing may be the most ideal from the standpoint of economy. For example, after giving a high impact polystyrene web (preferably about 8 mils thick and stained for color and any degree of opacity) a surface treatment such as the well-known corona surface treatment, the web is repetitively printed with informational matter as intended for each tag to be later cut from it. The printed (styrenic) tag material web is fed simultaneously with molten elastomer (e.g., a thermoplastic elastomer such as styrenic block copolymer) through the nip of chill rollers. The molten elastomer is applied to extend with a sufficient overlap onto the lateral edges of the web to create the bond zone as well as to extend sufficiently laterally outward from the bond zone (i.e, lateral edge of web) to provide material for the elastic loop. The temperatures of the chill rollers (from about 200 degrees Fahrenheit to about 40 degrees F.) is adjusted to cool the molten elastomer to a "frozen" state while simultaneously applying pressure by the rollers (up to about 500 psi) to effect the formation of a layer of elastomer at the thickness desired and also to effect formation of the bond zone. The outermost edge of the elastomeric layer is longitudinally cut off to create an even edge, following which the lateral and longitudinal positioning of the composite web (of tag and elastomer) is controlled as it is passed in proper registration between die cutting and anvil rollers to cut and score individual tag profiles that are then severed into individual tags of the invention.

The structure of the new labeling article of the invention is believed to be totally strange from anything that has been contemplated in the past. The new article is flexible and sheet-like in character throughout its entire extent, but the labeling tag part of the new structure is of a composition different from the elastic part of the new article. Different properties for different parts of the article, while maintaining a sheet-like character for the entire article (albeit of optionally different thicknesses in different parts) has given results that are looked upon as somewhat astonishing in view of merchandise labels that have been known and available in the past. There appears to have been nothing heretofore to suggest the unique arrangement of elements to get the special performance characteristics exhibited by the new product.

Figure 9:
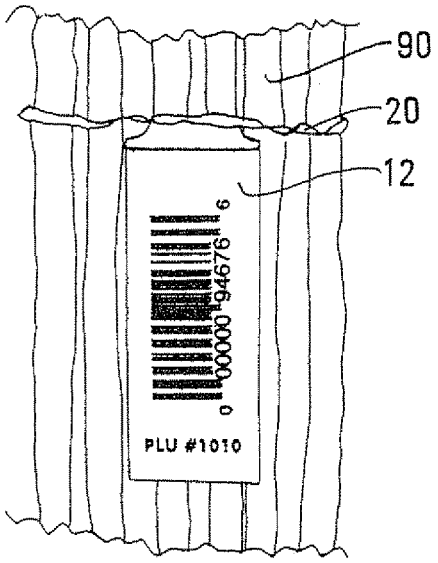
FIG. 9 is a schematic representation of merchandise banded with the new article of the invention.

Speedy application of the new article to merchandise in a single tagging step can be accomplished in a variety of ways. For factory operations, the new labeling articles may be stacked or sequenced by conveyor to a mechanical applicator. Hand application at a variety of off-factory sites can be easily accomplished. A person can align the loops of the tag on some carrier so as to make each labeling article quickly and conveniently accessible for hand application. Some may align a multitude of articles on their arms; others may align on some sort of movable carrier. Some may just place the new labeling article in a bag and grab from the bag in affixing the labeling article on merchandise. Many are apt to use the fingers of both hands to stretch the elastomeric loop in placing it about merchandise, but others may exert some pull on the tag portion as they place the loop about merchandise. Nevertheless, the bond zone is not likely to ever receive the extremes of strain and stress that the elastic fastening loop itself is likely to receive. FIG. 9 illustrates use of the new article on a clump of merchandise 90, with the fastening loop 20 surrounding the merchandise and the tag 12 dangling from the loop.

The new article (when made resistant to water damage) is very useful for field application of it to agricultural product even before the produce is washed. But it obviously can conveniently be applied to washed agricultural produce. Further, the new labeling article has a multitude of other uses because of its unique properties and ease of attachment (i.e., fastening on merchandise). Elongated manufactured products can easily be clumped using the new article. Slender necked bottles (as for soft drinks, beer, ketchup, syrup, etc.) can readily carry the new labeling article—and circular loops are especially advantageous for this use. Floral arrangements can easily be labeled using the new labeling article. After being looped about merchandise, the pulling forces against the bond zone 14 are mighty low, and indeed may even be insignificant, inasmuch as dispersion and even dissipation of loop in-line stretching tension takes place with the result that the bonding zone is subjected to little stress even though the elastic loop is in stretched condition about merchandise.

Further, those skilled in the art will readily recognize that this invention may be embodied in still other specific forms than illustrated without departing from the spirit or essential characteristics of it. The illustrated embodiments are therefore to be considered in all respects illustrative and not restrictive, the scope of the invention being indicated by the appended claims rather than the foregoing description, and all variations that come within the meaning and range of equivalency of the claims are therefore intended to be embraced thereby.

The invention claimed is:

1. A labeling article including:

a material sheet including a first edge; and an elastic sheet including an aperture and a second edge;

wherein the material sheet and the elastic sheet overlap at an overlap portion defined between the first and second edges, wherein the material sheet and the elastic sheet are bonded together at the overlap portion, and wherein the aperture of the elastic sheet is not located on the overlap portion.

2. The article of claim 1, wherein the elastic sheet further includes a dispersion zone defined between the aperture and the overlap portion.

3. The article of claim 2, wherein the dispersion zone is of sufficient size to reduce transmission of stretching forces applied at the aperture into the overlap portion.

4. The article of claim 2 wherein the dispersion zone has:

a first width proximate the overlap area, and a second width that is narrower than the first width between the aperture and the overlap area.

5. The article of claim 4 wherein the elastic sheet has a third width proximate the aperture that is wider than the second width.

6. The article of claim 4 wherein the first width is about equal to a width of the material sheet at the overlap area.

7. The article of claim 1, wherein a distance between the first and second edges is about ¼ inch to about ½ inch.

8. The article of claim 1 wherein a circumference of the aperture defines an inner circumference of a loop; and wherein, when the loop is in a maximally stretched condition, the inner circumference is at least three times greater than when the loop is in an unstretched condition.

9. The article of claim 1 further including a bonding material disposed between the material sheet and the elastic sheet at the overlap portion.

10. The article of claim 1 wherein the material sheet includes a thermoplastic material.

11. The article of claim 1 wherein the material sheet includes high impact polystyrene.

12. The article of claim 1 wherein the material sheet includes polystyrene and a styrene-butadiene-styrene modifier of up to about 40 percent of a weight of the polystyrene.

13. The article of claim 1 wherein the material sheet has a corona-treated surface.

14. The article of claim 1 wherein the material sheet carries water-resistant printing.

15. The article of claim 1 wherein a portion of a back surface of the material sheet overlaps a portion of a front surface of the elastic sheet at the overlap portion, and wherein printing is provided on a front surface of the material sheet.

16. The article of claim 15 wherein a width of the portion of the back surface of the material sheet is about equal to a width of the portion of the front surface of the elastic sheet at the overlap portion.

17. The article of claim 1 wherein the material sheet is not elastic.

18. The article of claim 1 wherein printing is provided on a front surface of the material sheet.

19. The article of claim 18 further including a plastic film provided on the front surface of the material sheet.

* * * * *